US005200118A

United States Patent [19]

Hermle

[11] Patent Number: 5,200,118

[45] Date of Patent: Apr. 6, 1993

[54] CARBURETOR FOR CHAIN SAWS

[75] Inventor: Elmar Hermle, Hülben, Fed. Rep. of Germany

[73] Assignee: Walbro Corporation, Cass City, Mich.

[21] Appl. No.: 890,574

[22] Filed: May 28, 1992

[30] Foreign Application Priority Data

May 29, 1991 [DE] Fed. Rep. of Germany ..... 4117554

[51] Int. Cl.[5] ..... F02M 1/02

[52] U.S. Cl. ..... 261/64.6

[58] Field of Search ..... 261/64.6; 123/179.18

[56] References Cited

U.S. PATENT DOCUMENTS

| | | | |
|---|---|---|---|
| 1,440,245 | 12/1922 | Scott | 261/64.6 |
| 3,342,465 | 9/1967 | Szwargulski et al. | 261/64.6 |
| 4,439,377 | 3/1984 | Nartowski | 261/64.6 |
| 4,490,309 | 12/1984 | Fujikawa et al. | 261/64.6 |

*Primary Examiner*—Tim Miles

*Attorney, Agent, or Firm*—Barnes, Kisselle, Raisch, Choate, Whittemore & Hulbert

[57] ABSTRACT

Carburetor for internal combustion engine for movable equipment such as a chain saw which includes throttle and choke valves, each of which is actuatable by its own actuating member. Furthermore, a holding member for the throttle valve is provided, which holding member is operatively separate from the choke valve and actuatable by a third actuating member. The holding member cooperates with the throttle valve so that it is moved to a defined start position when the throttle valve is actuated, and holds the throttle valve in its start position via detent means. When the internal combustion engine is running and the throttle valve is displaced further by its own actuating member, the detent means is released so that the holding member is returned to its rest position by a return spring. Operatively separating the holding member and choke valve allows to move the throttle valve, for warm starting the engine, to its start position without requiring any displacement of the choke valve.

7 Claims, 1 Drawing Sheet

CARBURETOR FOR CHAIN SAWS

FIELD OF INVENTION

The present invention relates to a carburetor for an internal combustion engine for portable equipment such as a chain saw, a wheat cutting machine and the like.

BACKGROUND AND FEATURES OF THE INVENTION

In carburetors of this type it is necessary to move the throttle means (throttle valve) and the starter means (choke valve) to a defined start position for cold starting of the engine. To this end, the prior art carburetors usually are provided with actuating members for the throttle and choke valves. In one type of such carburetors, the actuating member of the throttle valve has a detent member locking the throttle valve in its start position. Due to manufacturing tolerances of the force transmitting mechanism between the throttle valve and its actuating member, it is difficult, if not impossible, to obtain a precisely defined start position of the throttle valve; actually the start positions of the throttle valves of different carburetors vary within a relatively large range of manufacturing tolerances.

German patent application 27 06 389 discloses a carburetor wherein the throttle valve is held in its start position by a holding member. The holding member which comprises a lever cooperates with the throttle valve via detent means such that it displaces the throttle valve into its start position and holds it therein until the detent means is released due to displacement of the throttle valve. The holding member is returned to its rest position by a return spring. In this carburetor the holding member and the choke valve are interlinked so that the holding member is moved into its start position by the actuating member of the choke valve, and the holding member when being returned moves the choke valve into its rest position.

The holding member coupled to the choke valve and directly cooperating with the throttle valve provides for a precisely defined start position of the throttle valve. If, however, in this carburetor the throttle valve, for warm starting of the engine, is moved into its start position by the holding member, it is inevitable that also the choke valve is moved into its cold start position due to the coupling between the choke valve and the holding member; such movement of the choke valve to its cold start position is, of course, not desired for warm starting of the engine.

It is an object of the present invention to provide a carburetor for an internal combustion engine in particular of a chain saw or the like wherein the throttle means is adapted to be moved into a precisely defined start position while an undesired displacement of the starter means in case of warm starting the engine should be avoided.

To this end, a carburetor for an internal combustion engine, in particular of a chain saw, includes throttle means biased towards an idle position and adapted to be displaced by a first actuating member, and includes also starter means adapted to be displaced between start and rest positions by a second actuating member, and holding means which, when actuated, moves the throttle means to a start position and holds the throttle means in the start position via detent means. The detent means is released by the first actuating member when the throttle means continues to be displaced such that the holding means returns into its rest position under the action of return spring means. The above concept is characterized in that the holding means is operatively separate from the starter means and arranged to be actuated by a third actuating member.

Due to the holding means being operatively separate from the starter means, the throttle valve, for warm starting the engine, may be moved into its start position via the actuating member of the holding means without the necessity of displacing the starter means. Nevertheless, the start position of the throttle means is precisely defined by the holding means.

BRIEF DESCRIPTION OF THE DRAWINGS

With reference to the accompanying drawings, preferred embodiment of the present application will be described. In the drawings.

DETAILED DESCRIPTION OF THE INVENTION AND THE MANNER AND PROCESS OF USING IT

Figure 1:
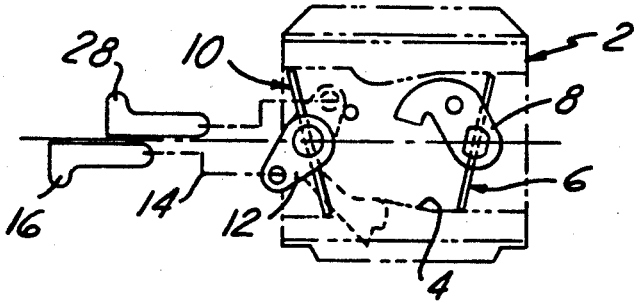
FIG. 1 is a schematic view of a carburetor wherein the choke valve is in its start position and the holding member (indicated by dotted lines) is an in its rest position.
Figure 2:
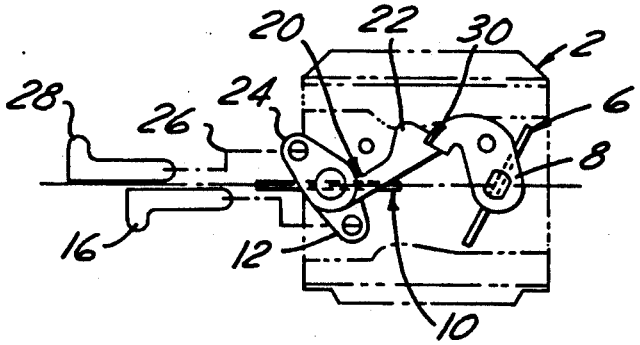
FIG. 2 is a view corresponding to FIG. 1, wherein the holding member is in its start position and the choke valve (indicated by dotted lines) is in its rest position.
Figure 3:
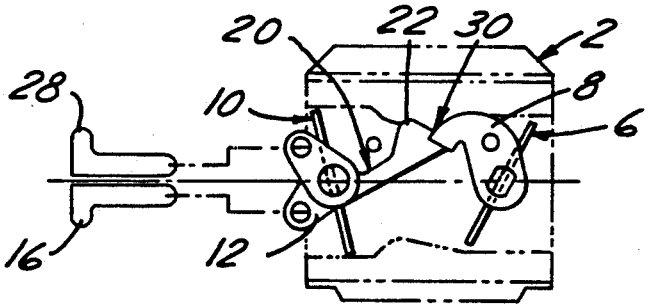
FIG. 3 is a view corresponding to the preceding figures, wherein both the choke valve and the holding members are in their start positions.
Figure 4:
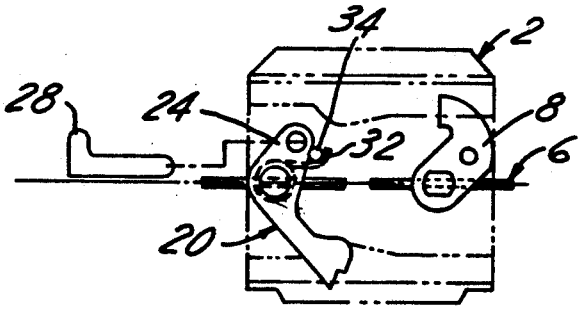
FIG. 4 is a view corresponding to the preceding figures, wherein the actuating member of the choke valve has been omitted in order to show the return spring of the holding member.

The carburetor 2, schematically shown in FIGS. 1 to 5, includes an air intake passage 4 having a throttle means comprised of a throttle valve or throttle flap 6 pivotally mounted therein. Throttle valve 6 is biased by resilient means (not shown) to an idle position (FIGS. 1, 5) and is connected to a control lever 8 so as to be rotatable thereby. Control lever 8 is connected to an actuating member (not shown) which enables to move the throttle valve from its idle position to its operative positions up to a maximum open position (FIG. 4).

Figure 5:
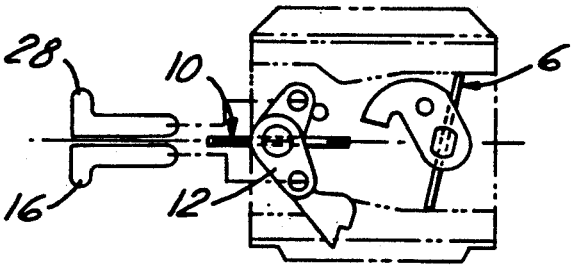
FIG. 5 is a view corresponding to the preceding figures, wherein both the throttle valve and the holding member (shown by dotted lines) are in their positions.

Furthermore, intake passage 4 includes starter means comprised of a rotatably mounted choke valve or choke flap 10. Choke valve 10 is connected to a control lever 12 so as to be rotatable thereby. Control lever 12 is connected via a linkage 14 to an actuating member 16 adapted to move choke valve 10 between a start position (FIGS. 1, 3) and a rest position (FIGS. 2, 4 and 5).

Furthermore, the carburetor includes a holding member 20 comprising an angled lever having a pair of arms 22,24. Holding member 20 is pivotal about the axis of choke valve 10 and is rotatably mounted e.g. on the shaft of the choke valve. Arm 24 of holding member 20 is connected to an actuating member 28 via a linkage 26. If holding member 20 is moved to its start position (FIGS. 2, 3) by actuating member 28, arm 22 cooperates with control lever 8 of throttle valve 6 via detent means 30 as will be explained in more detail below.

Holding member 20 is biased towards its rest position by a return spring 32 (FIG. 4); in the rest position arm 24 engages an abutment 34 comprising a pin.

Actuating member 16 of choke valve 10 and actuating member 28 of holding member 20 including linkages 14 and 16 are shown only schematically in the figures. They comprise, for example, slides arranged adjacent or within each other so that they may be moved from their rest position (FIG. 5) to their start positions (FIG. 3) by a single manual operation.

The operation of the carburetor as described is as follows:

For starting of the internal combustion engine (not shown) actuating member 16 of choke valve 10 and actuating member 28 of holding member 20 are moved simultaneously or subsequently from their rest positions (FIG. 5) to their start positions (FIG. 3). Choke valve 10 moves to its closed start position. When holding member 20 is displaced, it drives throttle valve 6 to its start position via arm 22 and control lever 8. As a result, detent means 30 between arm 22 and control lever 8 are engaged so that throttle valve 6 is held by holding member 20 in the start position precisely defined thereby.

When initial firings have occurred, choke valve 10 is returned to its open rest position by actuation of its actuating member 16 so that the internal combustion engine may be restarted. Firing of the internal combustion engine is facilitated by the fact that the throttle valve 6 remains in its start position (FIG. 2) due to detent means 30 being engaged.

When the internal combustion engine starts running, throttle valve 6 is moved in the opening direction via its actuating member. This releases detent means 30 whereupon return spring 32 returns holding member 22 to its rest position (FIG. 4).

For warm starting the engine, it is only actuating member 28 of holding member 20 which is moved to its start position, while holding member 20 drives throttle valve 6 to its start position. Displacement of the choke valve 10 is not necessary (FIG. 2).

FIG. 5 shows the positions of choke valve 10 and holding member 20 as well as of the their actuating members 16 and 28 when the engine is running while throttle valve 6 is in the idling position.

What is claimed is:

1. A carburetor for an internal combustion engine, in particular of a chain saw, including throttle means biased towards an idle position and adapted to be displaced by a first actuating member, starter means adapted to be displaced between start and rest positions by a second actuating member, and holding means which when actuated moves said throttle means to a start position and holds said throttle means in the start position via detent means, said detent means being released by said first actuating member when the throttle means continues to be displaced such that said holding means returns into its rest position under the action of return spring means, characterized in that said holding means (20) is operatively separate from the starter means (10) and is arranged to be actuated by a third actuating member (28).

2. The carburetor of claim 1 wherein said throttle means comprises a throttle valve (6) pivotally mounted in an intake passage (4) and cooperating with said holding means (20) via a first control lever (8).

3. The carburetor of claim 2, wherein said starter means comprises a choke valve (10) pivotally mounted in the intake passage (4) and connected to its actuating member (16) via a second control lever (12).

4. The carburetor of claim 3 wherein said holding means (20) comprises a double-armed lever having a pair of arms and being pivotal about an axis of said choke valve (10), one (22) of said arms cooperating with the control lever (8) of the throttle valve (6) and the other (24) of said arms being connected to the actuating member (28) of said holding means (20).

5. The carburetor of claim 4 characterized in that said double-armed lever of said holding means (20) is arranged to be urged against an abutment (34) defining said rest position via said return spring means (32).

6. The carburetor of claim 1 wherein said actuating members (16,28) of the starter means (10) and the holding means (20) are arranged to be adjacent to each other or within each other such that they are actuatable by a single manual operation.

7. The carburetor of claim 6 wherein the actuating members (16,28) of the starter means (10) and the holding means (20) comprise slides connected to the starter means (10) and the holding means (20), respectively, via linkage means (14,26).

* * * * *